US009685165B2

(12) United States Patent
Liu et al.

(10) Patent No.: US 9,685,165 B2
(45) Date of Patent: Jun. 20, 2017

(54) METHOD AND APPARATUS FOR PREDICTING HIGH BAND EXCITATION SIGNAL

(71) Applicant: HUAWEI TECHNOLOGIES CO., LTD., Shenzhen, Guangdong (CN)

(72) Inventors: Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/080,950

(22) Filed: Mar. 25, 2016

(65) Prior Publication Data

US 2016/0210979 A1 Jul. 21, 2016

Related U.S. Application Data

(63) Continuation of application No. PCT/CN2014/074711, filed on Apr. 3, 2014.

(30) Foreign Application Priority Data

Sep. 26, 2013 (CN) ..... 2013 1 0444734

(51) Int. Cl.
*G10L 21/00* (2013.01)
*G10L 19/00* (2013.01)
(Continued)

(52) U.S. Cl.
CPC ..... *G10L 19/12* (2013.01); *G10L 19/0208* (2013.01); *G10L 19/06* (2013.01);
(Continued)

(58) Field of Classification Search
USPC ..... 704/219–222, 500
See application file for complete search history.

(56) References Cited

U.S. PATENT DOCUMENTS 5,455,888 A 10/1995 Iyengar et al.
7,363,218 B2 * 4/2008 Jabri ..... G10L 19/173 704/219
(Continued)

FOREIGN PATENT DOCUMENTS

CN 101083076 A 12/2007
CN 101089951 A 12/2007
(Continued)

OTHER PUBLICATIONS

Bessette et al., "The adaptive multirate wideband speech codec (AMR-WB),", 2002, In IEEE Transactions on Speech and Audio Processing, vol. 10, No. 8, pp. 620-636, Nov. 2002.*
(Continued)

*Primary Examiner* — Olujimi Adesanya
(74) *Attorney, Agent, or Firm* — Huawei Technologies Co., Ltd.

(57) ABSTRACT

A method and an apparatus for predicting a high band excitation signal are disclosed. The method includes: acquiring, according to a received low band bitstream, a set of spectral frequency parameters that are arranged in an order of frequencies, calculating a spectral frequency parameter difference between every two spectral frequency parameters that have a same position interval; acquiring a minimum spectral frequency parameter difference from the calculated spectral frequency parameter differences; determining, according to a frequency bin that corresponds to the minimum spectral frequency parameter difference, a start frequency bin for predicting a high band excitation signal from a low band; and predicting the high band excitation signal from the low band according to the start frequency bin. By implementing embodiments of the present invention, a high band excitation signal can be better predicted, thereby improving performance of the high band excitation signal.

18 Claims, 9 Drawing Sheets

(51) Int. Cl.

| | |
|---|---|
| ***G10L 21/04*** | (2013.01) |
| ***G10L 19/12*** | (2013.01) |
| ***G10L 19/06*** | (2013.01) |
| ***G10L 19/08*** | (2013.01) |
| ***G10L 21/038*** | (2013.01) |
| ***G10L 19/02*** | (2013.01) |
| *G10L 19/24* | (2013.01) |

(52) U.S. Cl.
CPC ..... *G10L 19/08* (2013.01); *G10L 21/038* (2013.01); *G10L 19/24* (2013.01)

(56) References Cited

U.S. PATENT DOCUMENTS

| | | | | |
|---|---|---|---|---|
| 8,244,547 | B2 * | 8/2012 | Sudo | G10L 21/038 704/203 |
| 8,484,020 | B2 | 7/2013 | Krishnan et al. | |
| 8,484,036 | B2 * | 7/2013 | Vos | G10L 19/0208 704/219 |
| 9,269,364 | B2 * | 2/2016 | Grancharov | |
| 2004/0102966 | A1 | 5/2004 | Sung et al. | |
| 2006/0074643 | A1 * | 4/2006 | Lee | G10L 19/07 704/222 |
| 2007/0225971 | A1 * | 9/2007 | Bessette | G10L 19/0208 704/203 |
| 2008/0120118 | A1 * | 5/2008 | Choo | G10L 19/0208 704/500 |
| 2008/0294429 | A1 * | 11/2008 | Su | G10L 19/09 704/222 |
| 2009/0141790 | A1 * | 6/2009 | Kawashima | G10L 19/24 375/240 |
| 2010/0198587 | A1 | 8/2010 | Ramabadran et al. | |
| 2010/0198588 | A1 * | 8/2010 | Sudo | G10L 21/038 704/205 |
| 2011/0099004 | A1 * | 4/2011 | Krishnan | G10L 21/038 704/206 |
| 2012/0243526 | A1 * | 9/2012 | Yamamoto | G10L 19/0208 370/343 |
| 2013/0024191 | A1 | 1/2013 | Krutsch et al. | |
| 2013/0144614 | A1 | 6/2013 | Myllyla et al. | |
| 2014/0229171 | A1 * | 8/2014 | Atti | G10L 21/0388 704/225 |
| 2014/0257827 | A1 * | 9/2014 | Norvell | G10L 21/038 704/500 |
| 2015/0073784 | A1 * | 3/2015 | Gao | G10L 19/12 704/223 |
| 2015/0179190 | A1 * | 6/2015 | Nagle | G10L 19/08 704/210 |
| 2016/0196829 | A1 * | 7/2016 | Liu | G10L 21/038 704/500 |

FOREIGN PATENT DOCUMENTS

| | | | |
|---|---|---|---|
| CN | 101521014 | A | 9/2009 |
| CN | 101568959 | A | 10/2009 |
| CN | 102870156 | A | 1/2013 |
| CN | 103026407 | A | 4/2013 |
| CN | 103165134 | A | 6/2013 |
| EP | 1921610 | A2 | 5/2008 |
| WO | 2011128723 | A1 | 10/2011 |

OTHER PUBLICATIONS

3GPPTS26445, "EVS Codec Detailed Algorithmic Description", Nov. 2014, 3GPP Technical Specification (Release 12), 3GPP TS 26.445, pp. 1-12 and 603-606 of 626.*

Chennoukh et al, "Speech enhancement via frequency bandwidth extension using line spectral frequencies," 2001, In Acoustics, Speech, and Signal Processing, 2001. Proceedings. (ICASSP '01). 2001 IEEE International Conference on, Salt Lake City, UT, 2001, pp. 665-668 vol. 1.*

Kaniewska et al., "Enhanced AMR-WB bandwidth extension in 3GPP EVS codec," Dec. 2015, In IEEE Global Conference on Signal and Information Processing (GlobalSIP), Orlando, FL, 2015, pp. 652-656.*

Atti et al., "Super-wideband bandwidth extension for speech in the 3GPP EVS codec," Apr. 2015, In IEEE International Conference on Acoustics, Speech and Signal Processing (ICASSP), South Brisbane, QLD, 2015, pp. 5927-5931.*

Nour-Eldin et al, "Combining frontend-based memory with MFCC features for Bandwidth Extension of narrowband speech," 2009, In IEEE International Conference on Acoustics, Speech and Signal Processing, Taipei, 2009, pp. 4001-4004.*

"Digital cellular telecommunications system (Phase 2+); Universal Mobile Telecommunications System (UMTS); Speech codec speech processing functions; Adaptive Multi-Rate-Wideband (AMR-WB) speech codec; Transcoding functions (3GPP TS 26.190 version 7.0.0 Release 7)", ETSI TS 126 190 V7.0.0, Jun. 2007, total 55 pages.

"Series G: Transmission Systems and Media, Digital Systems and Networks Digital terminal equipments—Coding of voice and audio signals", ITU-T G.722, Sep. 2012, total 274 pages.

"3rd Generation Partnership Project; Technical Specification Group Radio Access Network; Evolved Universal Terrestrial Radio Access (E-UTRA); Physical channels and modulation (Release 11)", 3GPP TS 36.211 V11.4.0, Sep. 2013, total 120 pages.

G.729-based embedded variable bit-rate coder: An 8-32 kbit/s scalablewideband coder bitstream interoperable with G.729. ITU-T Recommendation G.729.1.(May 2006). total 100 pages.

Pooja Gajjar et al: "Artificial Bandwidth Extension of Speech & its Applications in Wireless Communication Systems: A review", 2012 International Conference on Communication Systems and Network Technologies, total 6 pages.

* cited by examiner

METHOD AND APPARATUS FOR PREDICTING HIGH BAND EXCITATION SIGNAL

CROSS-REFERENCE TO RELATED APPLICATIONS

The application is a continuation of International Application No. PCT/CN2014/074711, filed on Apr. 3, 2014, which claims priority to Chinese Patent Application No. 201310444734.4, filed on Sep. 26, 2013, both of which are hereby incorporated by reference in their entireties.

TECHNICAL FIELD

The present invention relates to the field of communications technologies, and in particular, to a method and an apparatus for predicting a high band excitation signal.

BACKGROUND

As a requirement on a voice service quality becomes increasingly high in modern communications, the 3rd Generation Partnership Project (3GPP) proposes an adaptive multi-rate wideband (AMR-WB) voice codec. The AMR-WB voice codec has advantages such as a high voice reconstruction quality, a low average coding rate, and good self-adaptation, and is the first voice coding system that can be simultaneously used for wireless and wired services in the communications history. In an actual application, on a decoder side of an AMR-WB voice codec, after receiving a low band bitstream sent by an encoder, the decoder may decode the low band bitstream to obtain a low band linear prediction coefficient (LPC), and predict a high-frequency or wideband LPC coefficient by using the low band LPC coefficient. Furthermore, the decoder may use random noise as a high band excitation signal, and synthesize a high band signal by using the high band or wideband LPC coefficient and the high band excitation signal.

However, it is found in practice that, although the high band signal may be synthesized by using the random noise that is used as the high band excitation signal and the high band or wideband LPC coefficient, because the random noise is often much different from an original high band excitation signal, performance of the high band excitation signal is relatively poor, which ultimately affects performance of the synthesized high band signal.

SUMMARY

Embodiments of the present invention disclose a method and an apparatus for predicting a high band excitation signal, which can better predict a high band excitation signal, thereby improving performance of the high band excitation signal.

A first aspect of the embodiments of the present invention discloses a method for predicting a high band excitation signal, including:

acquiring, according to a received low band bitstream, a set of spectral frequency parameters that are arranged in an order of frequencies, where the spectral frequency parameters include low band line spectral frequency (LSF) parameters or low band immittance spectral frequency (ISF) parameters;

for the set of spectral frequency parameters, calculating a spectral frequency parameter difference between every two spectral frequency parameters that have a same position interval in some or all of the spectral frequency parameters;

acquiring a minimum spectral frequency parameter difference from the calculated spectral frequency parameter differences;

determining, according to a frequency bin that corresponds to the minimum spectral frequency parameter difference, a start frequency bin for predicting a high band excitation signal from a low band; and predicting the high band excitation signal from the low band according to the start frequency bin.

In a first possible implementation manner of the first aspect of the embodiments of the present invention, the acquiring, according to a received low band bitstream, a set of spectral frequency parameters that are arranged in an order of frequencies includes:

decoding the received low band bitstream, to obtain the set of spectral frequency parameters that are arranged in an order of frequencies; or decoding the received low band bitstream, to obtain a low band signal, and calculating, according to the low band signal, the set of spectral frequency parameters that are arranged in an order of frequencies.

With reference to the first possible implementation manner of the first aspect of the embodiments of the present invention, in a second possible implementation manner of the first aspect of the embodiments of the present invention, if the set of spectral frequency parameters that are arranged in an order of frequencies are obtained by decoding the received low band bitstream, the method further includes:

decoding the received low band bitstream, to obtain a low band excitation signal; and the predicting the high band excitation signal from the low band according to the start frequency bin includes:

selecting, from the low band excitation signal, a frequency band with preset bandwidth as the high band excitation signal according to the start frequency bin.

With reference to the second possible implementation manner of the first aspect of the embodiments of the present invention, in a third possible implementation manner of the first aspect of the embodiments of the present invention, the method further includes:

converting the spectral frequency parameters obtained by decoding to low band LPC coefficients;

synthesizing a low band signal by using the low band LPC coefficients and the low band excitation signal;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

With reference to the second possible implementation manner of the first aspect of the embodiments of the present invention, in a fourth possible implementation manner of the first aspect of the embodiments of the present invention, the method further includes:

converting the spectral frequency parameters obtained by decoding to low band LPC coefficients;

synthesizing a low band signal by using the low band LPC coefficients and the low band excitation signal;

predicting a high band envelope according to the low band signal;

synthesizing a high band signal by using the high band excitation signal and the high band envelope; and combining the low band signal with the high band signal, to obtain a wideband signal.

With reference to the first possible implementation manner of the first aspect of the embodiments of the present invention, in a fifth possible implementation manner of the first aspect of the embodiments of the present invention, if the low band signal is obtained by decoding the received low band bitstream, and the set of spectral frequency parameters that are arranged in an order of frequencies are calculated according to the low band signal, the predicting the high band excitation signal from the low band according to the start frequency bin includes:

processing the low-frequency signal by using an LPC analysis filter, to obtain a low band excitation signal; and selecting, from the low band excitation signal, a frequency band with preset bandwidth as the high band excitation signal according to the start frequency bin.

With reference to the fifth possible implementation manner of the first aspect of the embodiments of the present invention, in a sixth possible implementation manner of the first aspect of the embodiments of the present invention, the method further includes:

converting the calculated spectral frequency parameters to low band LPC coefficients;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

With reference to the fifth possible implementation manner of the first aspect of the embodiments of the present invention, in a seventh possible implementation manner of the first aspect of the embodiments of the present invention, the method further includes:

predicting a high band envelope according to the low band signal;

synthesizing a high band signal by using the high band excitation signal and the high band envelope; and combining the low band signal with the high band signal, to obtain a wideband signal.

With reference to the first aspect of the embodiments of the present invention or any one of the first to the seventh possible implementation manners of the first aspect of the embodiments of the present invention, in an eighth possible implementation manner of the first aspect of the embodiments of the present invention, the every two spectral frequency parameters that have a same position interval include every two adjacent spectral frequency parameters or every two spectral frequency parameters spaced by a same quantity of spectral frequency parameters.

A second aspect of the embodiments of the present invention discloses an apparatus for predicting a high band excitation signal, including:

a first acquiring unit, configured to acquire, according to a received low band bitstream, a set of spectral frequency parameters that are arranged in an order of frequencies, where the spectral frequency parameters include low band line spectral frequency (LSF) parameters or low band immittance spectral frequency ISF parameters;

a calculation unit, configured to: for the set of spectral frequency parameters acquired by the first acquiring unit, calculate a spectral frequency parameter difference between every two spectral frequency parameters that have a same position interval in some or all of the spectral frequency parameters;

a second acquiring unit, configured to acquire a minimum spectral frequency parameter difference from the spectral frequency parameter differences calculated by the calculation unit;

a start frequency bin determining unit, configured to determine, according to a frequency bin that corresponds to the minimum spectral frequency parameter difference acquired by the second acquiring unit, a start frequency bin for predicting a high band excitation signal from a low band; and a high band excitation prediction unit, configured to predict the high band excitation signal from the low band according to the start frequency bin determined by the start frequency bin determining unit.

In a first possible implementation manner of the second aspect of the embodiments of the present invention, the first acquiring unit is specifically configured to decode the received low band bitstream, to obtain the set of spectral frequency parameters that are arranged in an order of frequencies; or is specifically configured to decode the received low band bitstream, to obtain a low band signal, and calculate, according to the low band signal, the set of spectral frequency parameters that are arranged in an order of frequencies.

With reference to the first possible implementation manner of the second aspect of the embodiments of the present invention, in a second possible implementation manner of the second aspect of the embodiments of the present invention, if the first acquiring unit is specifically configured to decode the received low band bitstream, to obtain the set of spectral frequency parameters that are arranged in an order of frequencies, the apparatus further includes:

a decoding unit, configured to decode the received low band bitstream, to obtain a low band excitation signal; and the high band excitation prediction unit is specifically configured to select, from the low band excitation signal obtained by the decoding unit, a frequency band with preset bandwidth as the high band excitation signal according to the start frequency bin determined by the start frequency bin determining unit.

With reference to the second possible implementation manner of the second aspect of the embodiments of the present invention, in a third possible implementation manner of the second aspect of the embodiments of the present invention, the apparatus further includes:

a first conversion unit, configured to convert the spectral frequency parameters obtained by the first acquiring unit to low band linear prediction coefficient (LPC) coefficients;

a first low band signal synthesizing unit, configured to synthesize a low band LPC coefficients obtained by means of conversion by the first conversion unit and the low band excitation signal obtained by the decoding unit into the low band signal;

a first LPC coefficient prediction unit, configured to predict high band or wideband LPC coefficients according to the low band LPC coefficients obtained by means of conversion by the first conversion unit;

a first high band signal synthesizing unit, configured to synthesize a high band signal by using the high band excitation signal selected by the high band excitation prediction unit and the high band or wideband LPC coefficients predicted by the first LPC coefficient prediction unit; and a first wideband signal synthesizing unit, configured to combine the low band signal synthesized by the first low band signal synthesizing unit with the high band signal synthesized by the first high band signal synthesizing unit, to obtain a wideband signal.

With reference to the second possible implementation manner of the second aspect of the embodiments of the present invention, in a fourth possible implementation manner of the second aspect of the embodiments of the present invention, the apparatus further includes:

a second conversion unit, configured to convert the spectral frequency parameters obtained by the first acquiring unit to low band linear prediction coefficient (LPC) coefficients;

a second low band signal synthesizing unit, configured to synthesize a low band LPC coefficients obtained by means of conversion by the second conversion unit and the low band excitation signal obtained by the decoding unit into the low band signal;

a first high band envelope prediction unit, configured to predict a high band envelope according to the low band signal synthesized by the second low band signal synthesizing unit;

a second high band signal synthesizing unit, configured to synthesize a high band signal by using the high band excitation signal selected by the high band excitation prediction unit and the high band envelope predicted by the first high band envelope prediction unit; and a second wideband signal synthesizing unit, configured to combine the low band signal synthesized by the second low band signal synthesizing unit with the high band signal synthesized by the second high band signal synthesizing unit, to obtain a wideband signal.

With reference to the first possible implementation manner of the second aspect of the embodiments of the present invention, in a fifth possible implementation manner of the second aspect of the embodiments of the present invention, if the first acquiring unit is specifically configured to decode the received low band bitstream, to obtain the low band signal, and calculate, according to the low band signal, the set of spectral frequency parameters that are arranged in an order of frequencies, the high band excitation prediction unit is specifically configured to process the low-frequency signal by using an LPC analysis filter, to obtain a low band excitation signal, and select, from the low band excitation signal, a frequency band with preset bandwidth as the high band excitation signal according to the start frequency bin determined by the start frequency bin determining unit.

With reference to the fifth possible implementation manner of the second aspect of the embodiments of the present invention, in a sixth possible implementation manner of the second aspect of the embodiments of the present invention, the apparatus further includes:

a third conversion unit, configured to convert the calculated spectral frequency parameters obtained by the first acquiring unit to low band linear prediction coefficient (LPC) coefficients;

a second LPC coefficient prediction unit, configured to predict high band or wideband LPC coefficients according to the low band LPC coefficients obtained by means of conversion by the third conversion unit;

a third high band signal synthesizing unit, configured to synthesize a high band signal by using the high band excitation signal selected by the high band excitation prediction unit and the high band or wideband LPC coefficients predicted by the second LPC coefficient prediction unit; and a third wideband signal synthesizing unit, configured to combine the low band signal obtained by the first acquiring unit with the high band signal synthesized by the third high band signal synthesizing unit, to obtain a wideband signal.

With reference to the fifth possible implementation manner of the second aspect of the embodiments of the present invention, in a seventh possible implementation manner of the second aspect of the embodiments of the present invention, the apparatus further includes:

a third high band envelope prediction unit, configured to predict a high band envelope according to the low band signal obtained by the first acquiring unit;

a fourth high band signal synthesizing unit, configured to synthesize a high band signal by using the high band excitation signal selected by the high band excitation prediction unit and the high band envelope predicted by the third high band envelope prediction unit; and a fourth wideband signal synthesizing unit, configured to combine the low band signal obtained by the first acquiring unit with the high band signal synthesized by the fourth high band signal synthesizing unit, to obtain a wideband signal.

With reference to the second aspect of the embodiments of the present invention or any one of the first to the seventh possible implementation manners of the second aspect of the embodiments of the present invention, in an eighth possible implementation manner of the second aspect of the embodiments of the present invention, the every two spectral frequency parameters that have a same position interval include every two adjacent spectral frequency parameters or every two spectral frequency parameters spaced by a same quantity of spectral frequency parameters.

In the embodiments of the present invention, after a set of spectral frequency parameters that are arranged in an order of frequencies are acquired according to a received low band bitstream, a spectral frequency parameter difference between any two spectral frequency parameters, which have a same position interval, in this set of spectral frequency parameters may be calculated, and further, a minimum spectral frequency parameter difference is acquired from the calculated spectral frequency parameter differences, where the spectral frequency parameters include low band line spectral frequency (LSF) parameters or low band immittance spectral frequency ISF parameters, and therefore, the minimum spectral frequency parameter difference is a minimum LSF parameter difference or a minimum ISF parameter difference. It may be learned according to a mapping relationship between signal energy and a frequency bin that corresponds to an LSF parameter difference or an ISF parameter difference that, a smaller LSF parameter difference or ISF parameter difference indicates greater signal energy, and therefore, a start frequency bin for predicting a high band excitation signal from a low band is determined according to a frequency bin that corresponds to the minimum spectral frequency parameter difference (that is, the minimum LSF parameter difference or the minimum ISF parameter difference), and the high band excitation signal is predicted from the low band according to the start frequency bin, which can implement prediction of a high band excitation signal that have relatively good coding quality, so that the high band excitation signal can be better predicted, thereby effectively improving performance of the high band excitation signal.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely some rather than all of the embodiments of the present invention. All other embodiments obtained by a person of ordinary skill in the art based on the embodiments of the present invention without creative efforts shall fall within the protection scope of the present invention.

The embodiments of the present invention disclose a method and an apparatus for predicting a high band excitation signal, which can better predict a high band excitation signal, thereby improving performance of the high band excitation signal. Detailed descriptions are made below separately.

Figure 1:
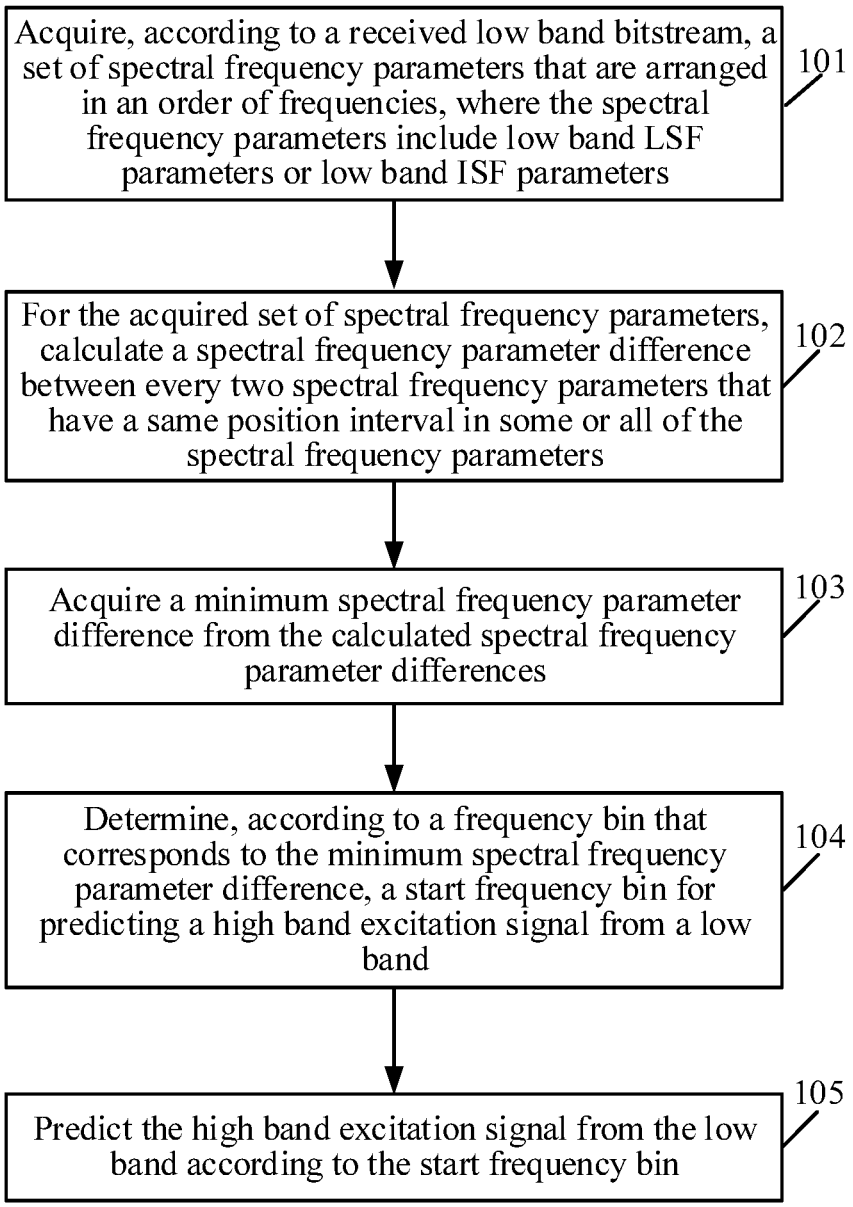
FIG. 1 is a schematic flowchart of a method for predicting a high band excitation signal disclosed by an embodiment of the present invention.

Referring to FIG. 1, FIG. 1 is a schematic flowchart of a method for predicting a high band excitation signal disclosed by an embodiment of the present invention. As shown in FIG. 1, the method for predicting a high band excitation signal may include the following steps:

101: Acquire, according to a received low band bitstream, a set of spectral frequency parameters that are arranged in an order of frequencies, where the spectral frequency parameters include low band LSF parameters or low band ISF parameters.

In this embodiment of the present invention, because the spectral frequency parameters include low band LSF parameters or low band ISF parameters, each low band LSF parameter or low band ISF parameter further corresponds to a frequency, and in a low band bitstream, frequencies corresponding to low band LSF parameters or low band ISF parameters are usually arranged in ascending order, a set of spectral frequency parameters that are arranged in an order of frequencies are a set of spectral frequency parameters that are that are arranged in an order of frequencies that correspond to the spectral frequency parameters.

In this embodiment of the present invention, the set of spectral frequency parameters that are arranged in an order of frequencies may be acquired by a decoder according to the received low band bitstream. The decoder may be a decoder in an AMR-WB voice codec, or may be a voice decoder, a low band bitstream decoder, or the like of another type, which is not limited in this embodiment of the present invention. The decoder in this embodiment of the present invention may include at least one processor, and the decoder may work under control of the at least one processor.

In an embodiment, after the decoder receives a low band bitstream sent by an encoder, the decoder may first directly decode the low band bitstream sent by the encoder to obtain line spectral pair (LSP) parameters, and then convert the LSP parameters to low band LSF parameters; or the decoder may first directly decode the low band bitstream sent by the encoder to obtain immittance spectral pair (ISP) parameters, and then convert the ISP parameters to low band ISF parameters.

Specific conversion processes in which the decoder converts the LSP parameters to the low band LSF parameters, and the decoder converts the ISP parameters to the low band ISF parameters are common knowledge known by a person skilled in the art, and are not described in detail herein in this embodiment of the present invention.

In this embodiment of the present invention, the spectral frequency parameter may also be any frequency domain indication parameter of an LPC coefficient, such as an LSP parameter or an LSF parameter, which is not limited in this embodiment of the present invention.

In another embodiment, after receiving a low band bitstream sent by an encoder, the decoder may decode the received low band bitstream, to obtain a low band signal, and calculate, according to the low band signal, the set of spectral frequency parameters that are arranged in an order of frequencies.

Specifically, the decoder may calculate LPC coefficients according to the low band signal, and then convert the LPC coefficients to LSF parameters or ISF parameters, where a specific calculation process in which the LPC coefficients are converted to the LSF parameters or ISF parameters is also common knowledge known by a person skilled in the art, and is also not described in detail herein in this embodiment of the present invention.

102: For the acquired set of spectral frequency parameters, calculate a spectral frequency parameter difference between every two spectral frequency parameters that have a same position interval in some or all of the spectral frequency parameters.

In this embodiment of the present invention, the decoder may select some spectral frequency parameters from the acquired set of spectral frequency parameters, and calculate a spectral frequency parameter difference between every two spectral frequency parameter, which have a same position interval, in the selected spectral frequency parameters. Certainly, in this embodiment of the present invention, the decoder may select all spectral frequency parameters from the acquired set of spectral frequency parameters, and calculate a spectral frequency parameter difference between every two spectral frequency parameter, which have a same position interval, in all the selected spectral frequency parameters. In other words, either the some or all the spectral frequency parameters are spectral frequency parameters in the acquired set of spectral frequency parameters.

In this embodiment of the present invention, after the decoder acquires the set of spectral frequency parameters (that is, the low band LSF parameters or the low band ISF parameters) that are arranged in an order of frequencies, the decoder may calculate, for this acquired set of spectral frequency parameters, a spectral frequency parameter difference between every two spectral frequency parameters, which have a same position interval, in (some or all of) this set of frequency parameters.

In an embodiment, the every two spectral frequency parameters that have a same position interval include every two spectral frequency parameters whose positions are adjacent, which for example, may be every two low band LSF parameters whose positions are adjacent (that is, a position interval is 0 LSF parameter) in a set of low band LSF parameters that are arranged in ascending order of frequencies, or may be every two low band ISF parameters whose positions are adjacent (that is, a position interval is 0 ISF parameters) in a set of low band ISF parameters that are arranged in ascending order of frequencies.

In another embodiment, the every two spectral frequency parameters that have a same position interval include every two spectral frequency parameters whose positions are spaced by a same quantity (such as one or two) of spectral frequency parameters, which for example, may be LSF [1] and LSF [3], LSF [2] and LSF [4], LSF [3] and LSF [5], or the like in a set of low band LSF parameters that are arranged in ascending order of frequencies, where position intervals of LSF [1] and LSF [3], LSF [2] and LSF [4], and LSF [3] and LSF [5] are all one LSF parameter, that is LSF [2], LSF [3], and LSF [4].

103: Acquire a minimum spectral frequency parameter difference from the calculated spectral frequency parameter differences.

In this embodiment of the present invention, after calculating the spectral frequency parameter differences, the decoder may acquire the minimum spectral frequency parameter difference from the calculated spectral frequency parameter differences.

104: Determine, according to a frequency bin that corresponds to the minimum spectral frequency parameter difference, a start frequency bin for predicting a high band excitation signal from a low band.

In this embodiment of the present invention, because the minimum spectral frequency parameter difference corresponds to two frequency bins, the decoder may determine, according to the two frequency bins, the start frequency bin for predicting the high band excitation signal from the low band. For example, the decoder may use a smaller frequency bin in the two frequency bin as the start frequency bin for predicting the high band excitation signal from the low band, or the decoder may use a greater frequency bin in the two frequency bins as the start frequency bin for predicting the high band excitation signal from the low band, or the decoder may use a frequency bin located between the two frequency bins as the start frequency bin for predicting the high band excitation signal from the low band, that is, the selected start frequency bin is greater than or equal to the smaller frequency bin in the two frequency bins, and is less than or equal to the greater frequency bin in the two frequency bins; and specific selection of the start frequency bin is not limited in this embodiment of the present invention.

For example, if a difference between LSF [2] and LSF [4] is a minimum LSF difference, the decoder may use a minimum frequency bin corresponding to LSF [2] as the start frequency bin for predicting the high band excitation signal from the low band, or the decoder may use a maximum frequency bin corresponding to LSF [4] as the start frequency bin for predicting the high band excitation signal from the low band, or the decoder may use a frequency bin in a frequency bin range between a minimum frequency bin that corresponds to LSF [2] and a maximum frequency bin that corresponds to LSF [4] as the start frequency bin for predicting the high band excitation signal from the low band, which is not limited in this embodiment of the present invention.

105: Predict the high band excitation signal from the low band according to the start frequency bin.

In this embodiment of the present invention, after determining the start frequency bin for predicting the high band excitation signal from the low band, the decoder may predict the high band excitation signal from the low band. For example, the decoder selects, from a low band excitation signal that corresponds to a low band bitstream, a frequency band with preset bandwidth as a high band excitation signal according to a start frequency bin.

In the method described in FIG. 1, after acquiring, according to a received low band bitstream, a set of spectral frequency parameters that are arranged in an order of frequencies, a decoder may calculate a spectral frequency parameter difference between every two spectral frequency parameters, which have a same position interval, in this set of the spectral frequency parameters, and further acquire a minimum spectral frequency parameter difference from the calculated spectral frequency parameter differences, where the spectral frequency parameters include low band line spectral frequency (LSF) parameters or low band immittance spectral frequency ISF parameters, and therefore, the minimum spectral frequency parameter difference is a minimum LSF parameter difference or a minimum ISF parameter difference. It may be learned according to a mapping relationship between signal energy and a frequency bin that corresponds to an LSF parameter difference or an ISF parameter difference that, a smaller LSF parameter difference or ISF parameter difference indicates greater signal energy, and therefore, the decoder determines, according to a frequency bin that corresponds to the minimum spectral frequency parameter difference (that is, the minimum LSF parameter difference or the minimum ISF parameter difference), a start frequency bin for predicting a high band excitation signal from a low band, and predicts the high band excitation signal from the low band according to the start frequency bin of the high band excitation signal, which can implement prediction of a high band excitation signal that have good coding quality, so that the high band excitation signal can be better predicted, thereby effectively improving performance of the high band excitation signal.

Figure 2:
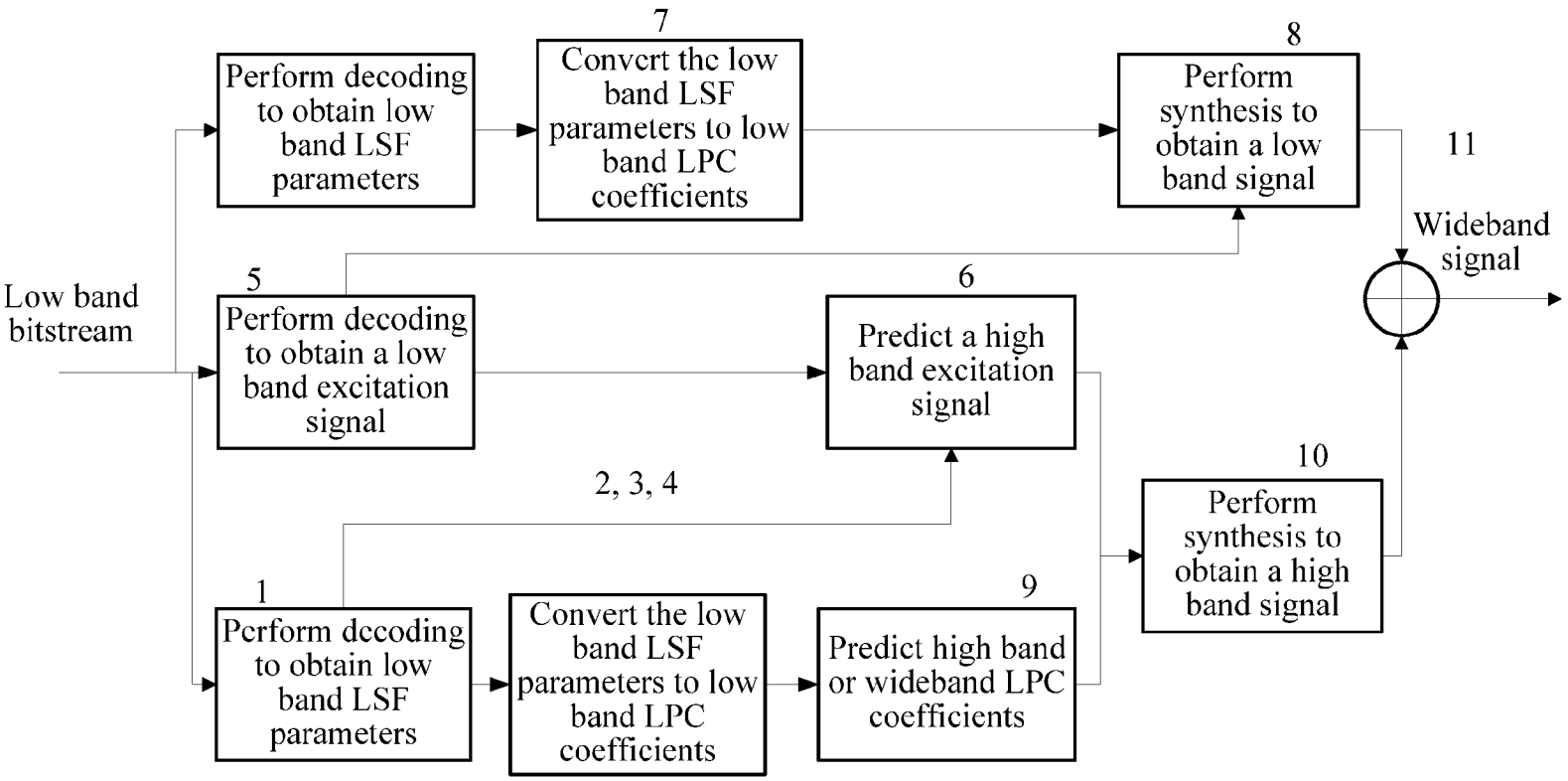
FIG. 2 is a schematic diagram of a process of predicting a high band excitation signal disclosed by an embodiment of the present invention.

Referring to FIG. 2, FIG. 2 is a schematic diagram of a process of predicting a high band excitation signal disclosed by an embodiment of the present invention. As shown in FIG. 2, the process of predicting a high band excitation signal is:

1. A decoder decodes a received low band bitstream, to obtain a set of low band LSF parameters that are arranged in an order of frequencies.

2. The decoder calculates, for the acquired set of low band LSF parameters, a difference LSF_DIFF between every two low band LSF parameters, which have adjacent positions, in (some or all of) this set of low band LSF parameters, and it is assumed that LSF_DIFF[i]=LSF[i+1]−LSF[i], where i≤M, i indicates the ith LSF, and M indicates a quantity of low band LSF parameters.

3. The decoder acquires a minimum difference MIN_LSF_DIFF from the calculated differences LSF_DIFF.

As an optional implementation manner, the decoder may determine, according to a rate of the low band bitstream, a range for searching for the minimum MIN_LSF_DIFF, that is, a position of a highest frequency that corresponds to LSF_DIFF, where a higher rate indicates a larger search range, and a lower rate indicates a smaller search range. For example, in an AMR-WB, when a rate is less than or equal to 8.85 kbps, a maximum value of i is M−8; or when a rate is less than or equal to 12.65 kbps, a maximum value of i is M−6; or when a rate less is than or equal to 15.85 kbps, a maximum value of i is M−4.

As an optional implementation manner, when a minimum MIN_LSF_DIFF is searched for, a correction factor α may be first used to correct LSF_DIFF, where α decreases with increase of a frequency, that is:

$$\alpha * LSF_DIFF[i] \leq MIN_LSF_DIFF, \text{ where } i \leq M, \text{ and } 0<\alpha<1.$$

4. The decoder determines, according to a frequency bin that corresponds to the minimum MIN_ LSF_DIFF, a start frequency bin for predicting a high band excitation signal from a low band.

5. The decoder decodes the received low band bitstream, to obtain a low band excitation signal.

6. The decoder selects, from the low band excitation signal, a frequency band with preset bandwidth as the high band excitation signal according to the start frequency bin.

Still further, the process of predicting a high band excitation signal shown in FIG. 2 may further include:

7. The decoder converts the low band LSF parameters obtained by decoding to low band LPC coefficients.

8. The decoder synthesizes a low band signal by using the low band LPC coefficients and the low band excitation signal.

9. The decoder predicts high band or wideband LPC coefficients according to the low band LPC coefficients.

10. The decoder synthesizes a high band signal by using the high band excitation signal and the high band or wideband LPC coefficients.

11. The decoder combines the low band signal with the high band signal, to obtain a wideband signal.

As an optional implementation manner, when a rate of a low band bitstream rate is greater than a given threshold, a signal, whose frequency band is adjacent to that of a high band signal, in a low band excitation signal obtained by decoding may be fixedly selected as a high band excitation signal; for example, in an AMR-WB, when a rate is greater than or equal to 23.05 kbps, a signal of a frequency band of 4 to 6 kHz may be fixedly selected as a high band excitation signal of a frequency band of 6 to 8 kHz.

As an optional implementation manner, in the method described in FIG. 2, the LSF parameters may also be replaced by ISF parameters, which does not affect implementation of the present invention.

In the process described in FIG. 2, a decoder predicts a high band excitation signal from a low band excitation signal according to a start frequency bin of the high band excitation signal, which can implement prediction of a high band excitation signal that have good coding quality, so that the high band excitation signal can be better predicted, thereby effectively improving performance of the high band excitation signal. Further, after the decoder combines a low band signal with a high band signal, performance of a wideband signal can also be improved.

Figure 3:
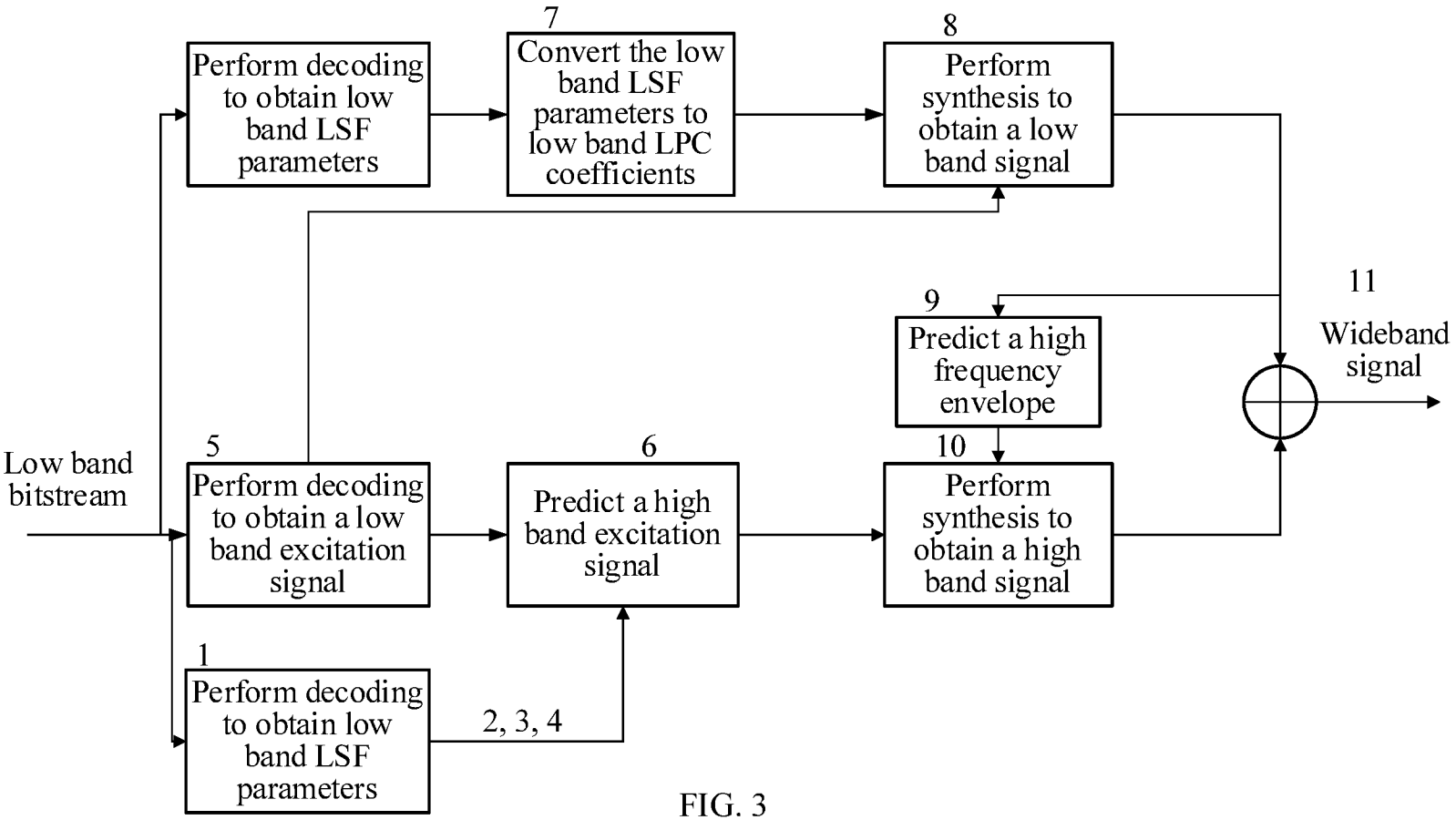
FIG. 3 is a schematic diagram of another process of predicting a high band excitation signal disclosed by an embodiment of the present invention.

Referring to FIG. 3, FIG. 3 is a schematic diagram of another process of predicting a high band excitation signal disclosed by an embodiment of the present invention. As shown in FIG. 3, the process of predicting a high band excitation signal is:

1. A decoder decodes a received low band bitstream, to obtain a set of low band LSF parameters that are arranged in an order of frequencies.

2. The decoder calculates, for the acquired set of low band LSF parameters, a difference LSF_DIFF between every two low band LSF parameters, which have a position interval of 2 low band LSF parameters, in (some or all of) this set of low band LSF parameters, and it is assumed that LSF_DIFF [i]=LSF[i+2]−LSF[i], where i≤M, i indicates the ith LSF, and M indicates a quantity of low band LSF parameters.

3. The decoder acquires a minimum MIN_LSF_DIFF from the calculated differences LSF_DIFF.

As an optional implementation manner, the decoder may determine, according to a rate of the low band bitstream, a range for searching for the minimum MIN_LSF_DIFF, that is, a position of a highest frequency that corresponds to LSF_DIFF, where a higher rate indicates a larger search range, and a lower rate indicates a smaller search range. For example, in an AMR-WB, when a rate is less than or equal to 8.85 kbps, a maximum value of i is M−8; or when a rate is less than or equal to 12.65 kbps, a maximum value of i is M−6; or when a rate less is than or equal to 15.85 kbps, a maximum value of i is M−4.

As an optional implementation manner, when a minimum MIN_LSF_DIFF is searched for, a correction factor α may be used to correct MIN_LSF_DIFF, where α decreases with increase of a frequency, that is:

$$LSF_DIFF[i] \leq \alpha * MIN_LSF_DIFF, \text{ where } i \leq M, \text{ and } \alpha>1.$$

4. The decoder determines, according to a frequency bin that corresponds to the minimum MIN_ LSF_DIFF, a start frequency bin for predicting a high band excitation signal from a low band.

5. The decoder decodes the received low band bitstream, to obtain a low band excitation signal.

6. The decoder selects, from the low band excitation signal, a frequency band with preset bandwidth as the high band excitation signal according to the start frequency bin.

Still further, the process of predicting a high band excitation signal shown in FIG. 3 may further include:

7. The decoder converts the low band LSF parameters obtained by decoding to low band LPC coefficients.

8. The decoder synthesizes a low band signal by using the low band LPC coefficients and the low band excitation signal.

9. The decoder predicts a high band envelope according to the synthesized low band signal.

10. The decoder synthesizes a high band signal by using the high band excitation signal and the high band envelope.

11. The decoder combines the low band signal with the high band signal, to obtain a wideband signal.

As an optional implementation manner, when a rate of a low band bitstream rate is greater than a given threshold, a signal, whose frequency band is adjacent to that of a high band signal, in a low band excitation signal obtained by decoding may be fixedly selected as a high band excitation signal; for example, in an AMR-WB, when a rate is greater than or equal to 23.05 kbps, a signal of a frequency band of 4 to 6 kHz may be fixedly selected as a high band excitation signal of 6 to 8 kHz.

As an optional implementation manner, in the method described in FIG. 3, the LSF parameters may also be replaced by ISF parameters, which does not affect implementation of the present invention.

In the process described in FIG. 3, a decoder predicts a high band excitation signal from a low band excitation signal according to a start frequency bin of the high band excitation signal, which can implement prediction of a high band excitation signal that have good coding quality, so that the high band excitation signal can be better predicted, thereby effectively improving performance of the high band excitation signal. Further, after the decoder combines a low band signal with a high band signal, performance of a wideband signal can also be improved.

Figure 4:
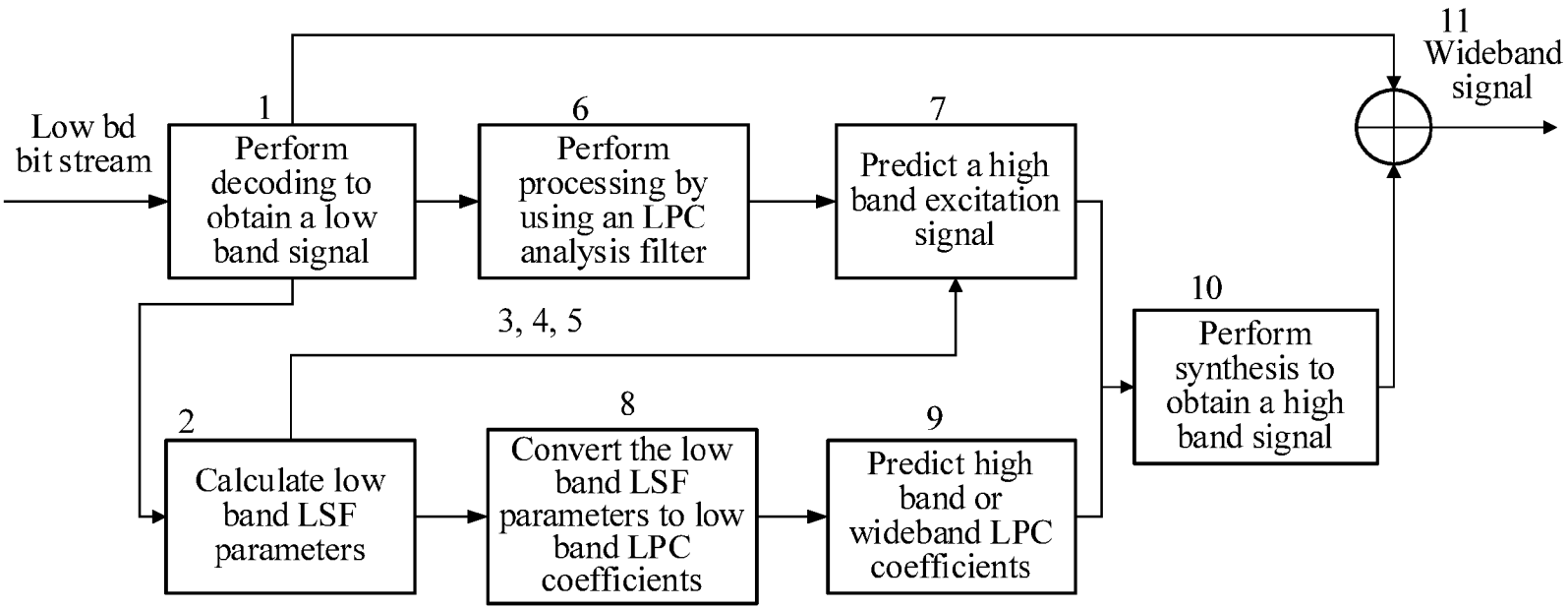
FIG. 4 is a schematic diagram of another process of predicting a high band excitation signal disclosed by an embodiment of the present invention.

Referring to FIG. 4, FIG. 4 is a schematic diagram of another process of predicting a high band excitation signal disclosed by an embodiment of the present invention. As shown in FIG. 4, the process of predicting a high band excitation signal is:

1. A decoder decodes a received low band bitstream, to obtain a low band signal.

2. The decoder calculates, according to the low band signal, a set of low band LSF parameters that are arranged in an order of frequencies.

3. The decoder calculates, for the set of calculated low band LSF parameters calculation, a difference LSF_DIFF between every two low band LSF parameters, which have adjacent positions, in (some or all of) this set of low band LSF parameters, and it is assumed that LSF_DIFF[i]=LSF[i+1]−LSF[i], where i≤M, i indicates the ith LSF, and M indicates a quantity of low band LSF parameters.

4. The decoder acquires a minimum MIN_LSF_DIFF from the calculated differences LSF_DIFF.

As an optional implementation manner, the decoder may determine, according to a rate of the low band bitstream, a range for searching for the minimum MIN_LSF_DIFF, that is, a position of a highest frequency that corresponds to LSF_DIFF, where a higher rate indicates a larger search range, and a lower rate indicates a smaller search range. For example, in an AMR-WB, when a rate is less than or equal to 8.85 kbps, a maximum value of i is M−8; or when a rate is less than or equal to 12.65 kbps, a maximum value of i is M−6; or when a rate less is than or equal to 15.85 kbps, a maximum value of i is M−4.

As an optional implementation manner, when minimum a MIN_LSF_DIFF is searched for, a correction factor α may be used to correct LSF_DIFF, where α decreases with increase of a frequency, that is:

$$\alpha * LSF_DIFF[i] \leq MIN_LSF_DIFF, \text{ where } i \leq M, \text{ and } 0<\alpha<1.$$

5. The decoder determines, according to a frequency bin that corresponds to the minimum MIN__ LSF_DIFF, a start frequency bin for predicting a high band excitation signal from a low band.

6. The decoder processes the low-frequency signal by using an LPC analysis filter, to obtain a low band excitation signal.

7. The decoder selects, from the low band excitation signal, a frequency band with preset bandwidth as the high band excitation signal according to the start frequency bin.

Still further, the process of predicting a high band excitation signal shown in FIG. 4 may further include:

8. The decoder converts the calculated low band LSF parameters to low band LPC coefficients.

9. The decoder predicts high band or wideband LPC coefficients according to the low band LPC coefficients.

10. The decoder synthesizes a high band signal by using the high band excitation signal and the high band or wideband LPC coefficients.

11. The decoder combines the low band signal with the high band signal, to obtain a wideband signal.

As an optional implementation manner, when a rate of a low band bitstream rate is greater than a given threshold, a signal, whose frequency band is adjacent to that of a high band signal, in a low band signal obtained by decoding may be fixedly selected as a high band excitation signal; for example, in an AMR-WB, when a rate is greater than or equal to 23.05 kbps, a signal of a frequency band of 4 to 6 kHz may be fixedly selected as a high band excitation signal of 6 to 8 kHz.

As an optional implementation manner, in the method described in FIG. 4, the LSF parameters may also be replaced by ISF parameters, which does not affect implementation of the present invention.

In the process described in FIG. 4, a decoder predicts a high band excitation signal from a low band signal according to a start frequency bin of the high band excitation signal, which can implement prediction of a high band excitation signal that have good coding quality, so that the high band excitation signal can be better predicted, thereby effectively improving performance of the high band excitation signal. Further, after the decoder combines a low band signal with a high band signal, performance of a wideband signal can also be improved.

Figure 5:
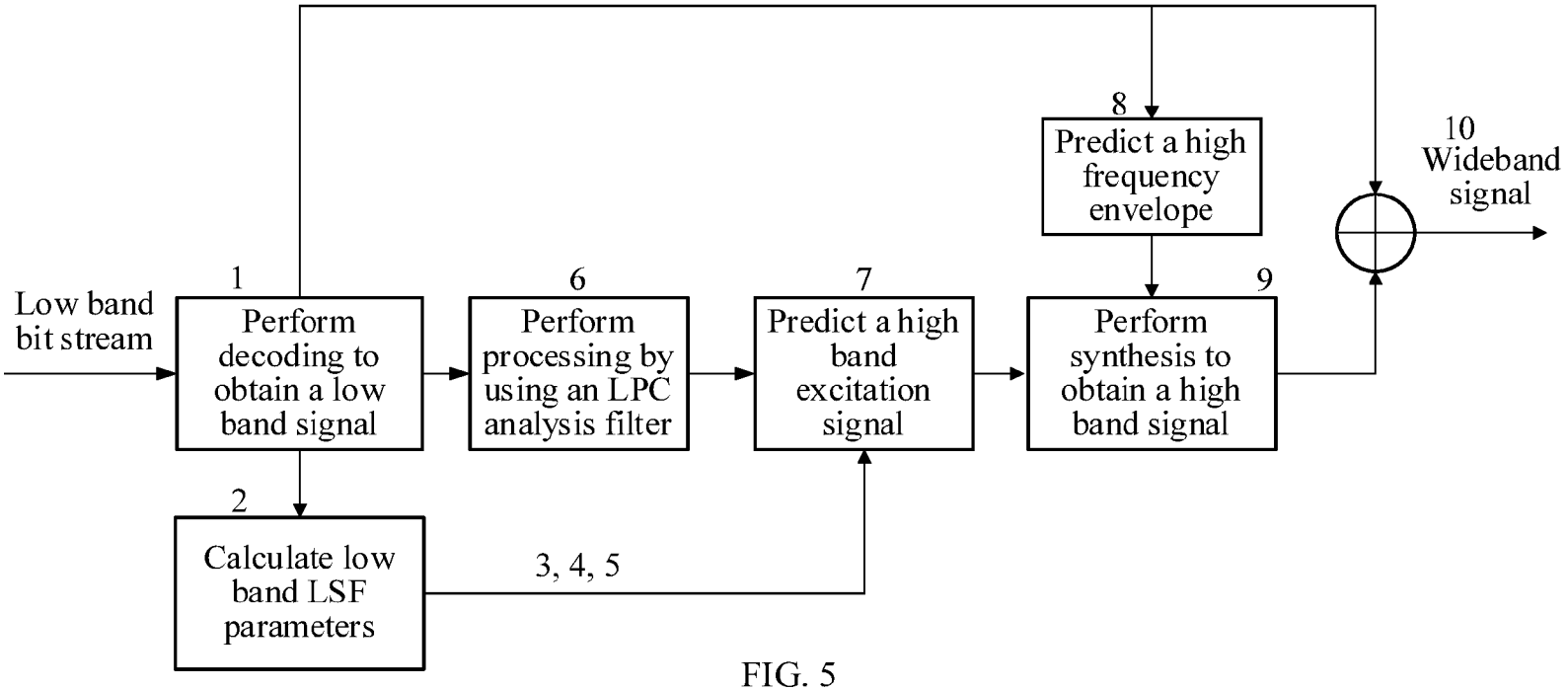
FIG. 5 is a schematic diagram of another process of predicting a high band excitation signal disclosed by an embodiment of the present invention.

Referring to FIG. 5, FIG. 5 is a schematic diagram of another process of predicting a high band excitation signal disclosed by an embodiment of the present invention. As shown in FIG. 5, the process of predicting a high band excitation signal is:

1. A decoder decodes a received low band bitstream, to obtain a low band signal.

2. The decoder calculates, according to the low band signal, a set of low band LSF parameters that are arranged in an order of frequencies.

3. The decoder calculates, for the set of calculated low band LSF parameters, a difference LSF_DIFF between every two low band LSF parameters, which have a position interval of 2 low band LSF parameters, in (some or all of) this set of low band LSF parameters, and it is assumed that LSF_DIFF[i]=LSF[i+2]−LSF[i], where i≤M, i indicates the ith difference, and M indicates a quantity of low band LSF parameters.

4. The decoder acquires a minimum MIN_LSF_DIFF from the calculated differences LSF_DIFF.

As an optional implementation manner, the decoder may determine, according to a rate of the low band bitstream, a range for searching for the minimum MIN_LSF_DIFF, that is, a position of a highest frequency corresponding to LSF_DIFF, where a higher rate indicates a larger search range, and a lower rate indicates a smaller search range. For example, in an AMR-WB, when a rate is less than or equal to 8.85 kbps, a maximum value of i is M−8; or when a rate is less than or equal to 12.65 kbps, a maximum value of i is M−6; or when a rate less is than or equal to 15.85 kbps, a maximum value of i is M−4.

As an optional implementation manner, when a minimum MIN_LSF_DIFF is searched for, a correction factor α may be used to correct MIN_LSF_DIFF, where α decreases with increase of a frequency, that is:

$$LSF_DIFF[i] \leq \alpha * MIN_LSF_DIFF, \text{ where } i \leq M, \text{ and } \alpha > 1.$$

5: The decoder determines, according to a frequency bin that corresponds to the minimum MIN_LSF_DIFF, a start frequency bin for predicting a high band excitation signal from a low band.

6. The decoder processes the low-frequency signal by using an LPC analysis filter, to obtain a low band excitation signal.

7. The decoder selects, from the low band excitation signal, a frequency band with preset bandwidth as the high band excitation signal according to the start frequency bin.

Still further, the process of predicting a high band excitation signal shown in FIG. 5 may further include:

8. The decoder predicts a high band envelope according to the low band signal.

In an embodiment, the decoder may predict the high band envelope according to low band LPC coefficients and the low band excitation signal.

9. The decoder synthesizes a high band signal by using the high band excitation signal and the high band envelope.

10. The decoder combines the low band signal with the high band signal, to obtain a wideband signal.

As an optional implementation manner, when a rate of a low band bitstream rate is greater than a given threshold, a signal, whose frequency band is adjacent to that of a high band signal, in a low band signal obtained by decoding may be fixedly selected as a high band excitation signal; for example, in an AMR-WB, when a rate is greater than or equal to 23.05 kbps, a signal of a frequency band of 4 to 6 kHz may be fixedly selected as a high band excitation signal of 6 to 8 kHz.

As an optional implementation manner, in the method described in FIG. 5, the LSF parameters may also be replaced by ISF parameters, which does not affect implementation of the present invention.

In the process described in FIG. 5, a decoder predicts a high band excitation signal from a low band signal according to a start frequency bin of the high band excitation signal, which can implement prediction of a high band excitation signal that have good coding quality, so that the high band excitation signal can be better predicted, thereby effectively improving performance of the high band excitation signal. Further, after the decoder combines a low band signal with a high band signal, performance of a wideband signal can also be improved.

Figure 6:
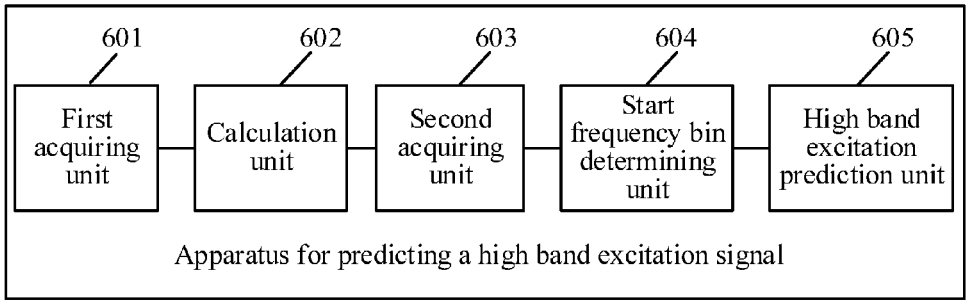
FIG. 6 is a schematic structural diagram of an apparatus for predicting a high band excitation signal disclosed by an embodiment of the present invention.

Referring to FIG. 6, FIG. 6 is a schematic structural diagram of an apparatus for predicting a high band excitation signal disclosed by an embodiment of the present invention. The apparatus for predicting a high band excitation signal shown in FIG. 6 may be physically implemented as an independent device, or may be used as a newly added part of a decoder, which is not limited in this embodiment of the present invention. As shown in FIG. 6, the apparatus for predicting a high band excitation signal may include:

a first acquiring unit 601, configured to acquire, according to a received low band bitstream, a set of spectral frequency parameters that are arranged in an order of frequencies, where the spectral frequency parameters include low band LSF parameters or low band ISF parameters;

a calculation unit 602, configured to: for the set of spectral frequency parameters acquired by the first acquiring unit 601, calculate a spectral frequency parameter difference between every two spectral frequency parameters that have a same position interval in some or all of the spectral frequency parameters;

a second acquiring unit 603, configured to acquire a minimum spectral frequency parameter difference from the spectral frequency parameter differences calculated by the calculation unit 602;

a start frequency bin determining unit 604, configured to determine, according to a frequency bin that corresponds to the minimum spectral frequency parameter difference acquired by the second acquiring unit 603, a start frequency bin for predicting a high band excitation signal from a low band; and a high band excitation prediction unit 605, configured to predict the high band excitation signal from the low band according to the start frequency bin determined by the start frequency bin determining unit 604.

As an optional implementation manner, the first acquiring unit 601 may be specifically configured to decode the received low band bitstream, to obtain the set of spectral frequency parameters that are arranged in an order of frequencies; or is specifically configured to decode the received low band bitstream, to obtain a low band signal, and calculate, according to the low band signal, the set of spectral frequency parameters that are arranged in an order of frequencies.

In an embodiment, the every two spectral frequency parameters that have a same position interval include every two adjacent spectral frequency parameters or every two spectral frequency parameters spaced by a same quantity of spectral frequency parameters.

The apparatus for predicting a high band excitation signal described in FIG. 6 can predict a high band excitation signal from a low band excitation signal according to a start frequency bin of a high band excitation signal, which can implement prediction of a high band excitation signal that have good coding quality, so that the high band excitation signal can be better predicted, thereby effectively improving performance of the high band excitation signal.

Figure 7:
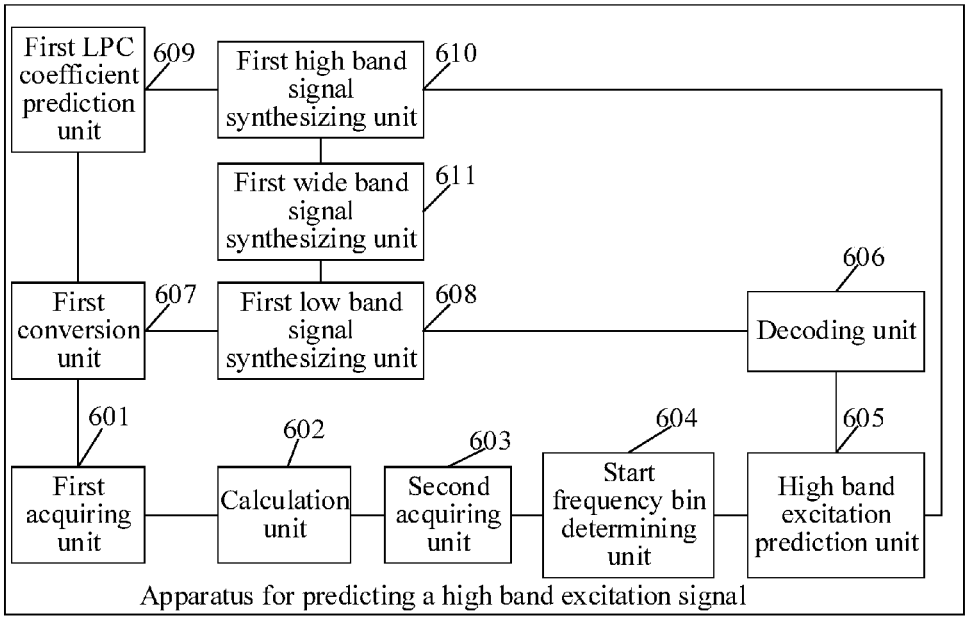
FIG. 7 is a schematic structural diagram of another apparatus for predicting a high band excitation signal disclosed by an embodiment of the present invention.

Also referring to FIG. 7, FIG. 7 is a schematic structural diagram of another apparatus for predicting a high band excitation signal disclosed by an embodiment of the present invention.

The apparatus for predicting a high band excitation signal shown in FIG. 7 is obtained by optimizing the apparatus for predicting a high band excitation signal shown in FIG. 6. In the apparatus for predicting a high band excitation signal shown in FIG. 7, if the first acquiring unit 601 is specifically configured to decode the received low band bitstream, to obtain the set of spectral frequency parameters that are arranged in an order of frequencies, in addition to all the units of the apparatus for predicting a high band excitation signal shown in FIG. 6, the apparatus for predicting a high band excitation signal shown in FIG. 7 may further include:

a decoding unit 606, configured to decode the received low band bitstream, to obtain a low band excitation signal; and correspondingly, the high band excitation prediction unit 605 is specifically configured to select, from the low band excitation signal obtained by the decoding unit 606, a frequency band with preset bandwidth as the high band excitation signal according to the start frequency bin determined by the start frequency bin determining unit 604.

As an optional implementation manner, the apparatus for predicting a high band excitation signal shown in FIG. 7 may further include:

a first conversion unit 607, configured to convert the spectral frequency parameters obtained by the first acquiring unit 601 to low band LPC coefficients;

a first low band signal synthesizing unit 608, configured to synthesize a low band signal by using the low band LPC coefficients obtained by means of conversion by the first conversion unit 607 and the low band excitation signal obtained by the decoding unit 606;

a first LPC coefficient prediction unit 609, configured to predict high band or wideband LPC coefficients according to the low band LPC coefficients obtained by means of conversion by the first conversion unit 607;

a first high band signal synthesizing unit 610, configured to synthesize a high band signal by using the high band excitation signal selected by the high band excitation prediction unit 605 and the high band or wideband LPC coefficients predicted by the first LPC coefficient prediction unit 608; and a first wideband signal synthesizing unit 611, configured to combine the low band signal synthesized by the first low band signal synthesizing unit 607 with the high band signal synthesized by the first high band signal synthesizing unit 609, to obtain a wideband signal.

Figure 8:
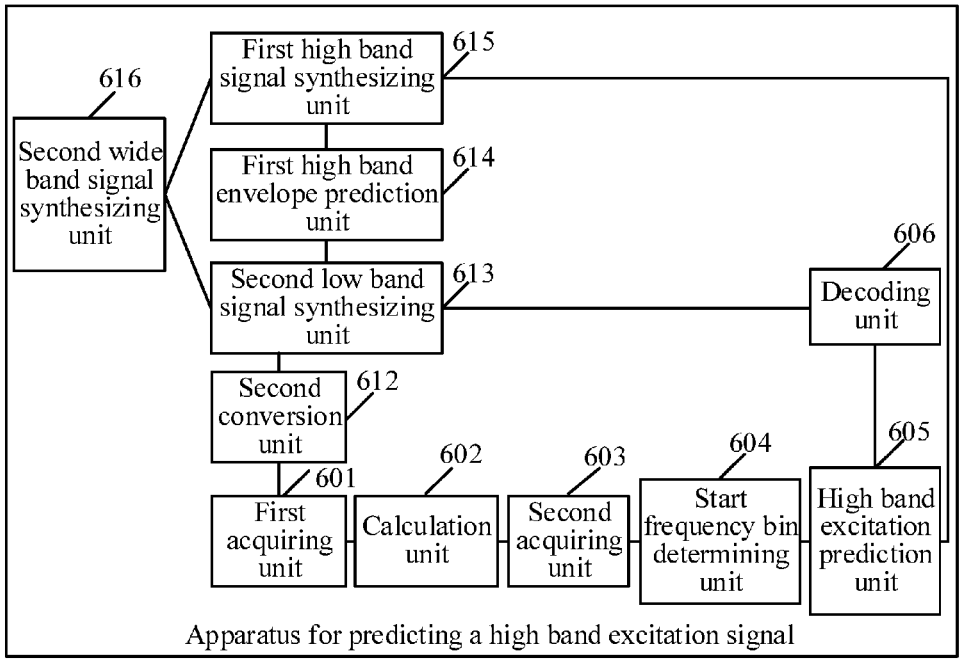
FIG. 8 is a schematic structural diagram of another apparatus for predicting a high band excitation signal disclosed by an embodiment of the present invention.

Also referring to FIG. 8, FIG. 8 is a schematic structural diagram of another apparatus for predicting a high band excitation signal disclosed by an embodiment of the present invention. The apparatus for predicting a high band excitation signal shown in FIG. 8 is obtained by optimizing the apparatus for predicting a high band excitation signal shown in FIG. 6. In the apparatus for predicting a high band excitation signal shown in FIG. 8, if the first acquiring unit 601 is specifically configured to decode the received low band bitstream, to obtain the set of spectral frequency parameters that are arranged in an order of frequencies, in addition to all the units of the apparatus for predicting a high band excitation signal shown in FIG. 6, the apparatus for predicting a high band excitation signal shown in FIG. 8 also further includes a decoding unit 606, configured to decode the received low band bitstream, to obtain a low band excitation signal; and correspondingly, the high band excitation prediction unit 605 is also configured to select, from the low band excitation signal obtained by the decoding unit 606, a frequency band with preset bandwidth as the high band excitation signal according to the start frequency bin determined by the start frequency bin determining unit 604.

As an optional implementation manner, the apparatus for predicting a high band excitation signal shown in FIG. 8 may further include:

a second conversion unit 612, configured to convert the spectral frequency parameters obtained by the first acquiring unit 601 to low band LPC coefficients;

a second low band signal synthesizing unit 613, configured to synthesize a low band LPC coefficients obtained by means of conversion by the second conversion unit 612 and the low band excitation signal obtained by the decoding unit 606 into the low band signal;

a first high band envelope prediction unit 614, configured to predict a high band envelope according to the low band signal synthesized by the second low band signal synthesizing unit 613;

a second high band signal synthesizing unit 615, configured to synthesize a high band signal by using the high band excitation signal selected by the high band excitation prediction unit 605 and the high band envelope predicted by the first high band envelope prediction unit 614; and a second wideband signal synthesizing unit 616, configured to combine the low band signal synthesized by the second low band signal synthesizing unit 613 with the high band signal synthesized by the second high band signal synthesizing unit 614, to obtain a wideband signal.

Figure 9:
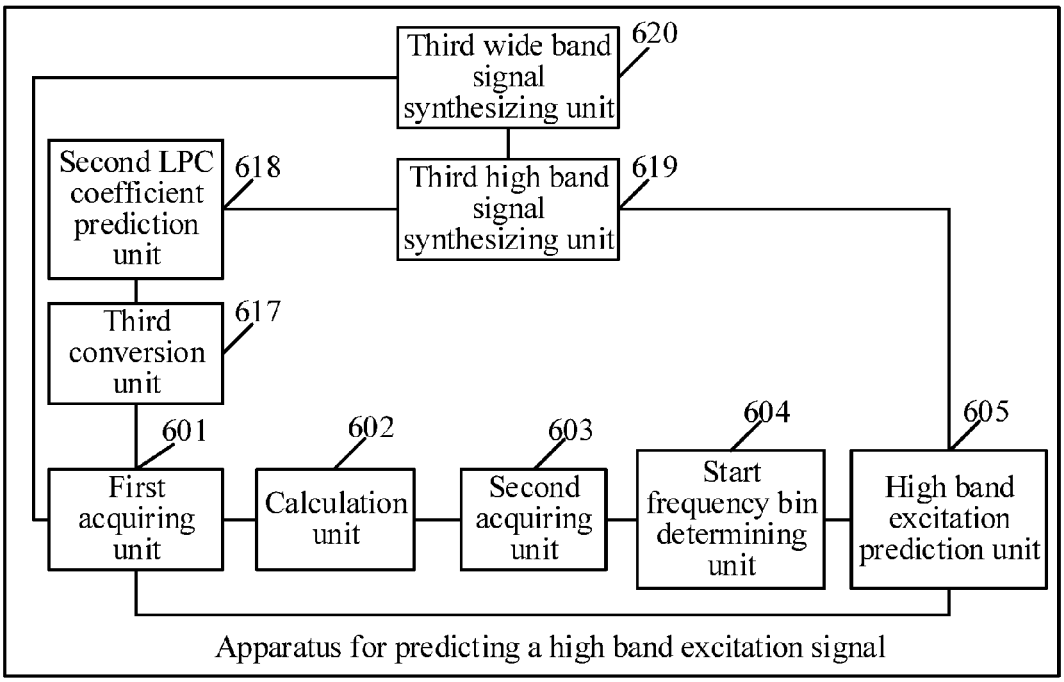
FIG. 9 is a schematic structural diagram of another apparatus for predicting a high band excitation signal disclosed by an embodiment of the present invention.

Also referring to FIG. 9, FIG. 9 is a schematic structural diagram of another apparatus for predicting a high band excitation signal disclosed by an embodiment of the present invention. The apparatus for predicting a high band excitation signal shown in FIG. 9 is obtained by optimizing the apparatus for predicting a high band excitation signal shown in FIG. 6. In the apparatus for predicting a high band excitation signal shown in FIG. 9, if the first acquiring unit 601 is specifically configured to decode the received low band bitstream, to obtain the low band signal, and calculate, according to the low band signal, the set of spectral frequency parameters that are arranged in an order of frequencies, the high band excitation prediction unit 605 is specifically configured to process the low-frequency signal by using an LPC analysis filter (which may be included in the high band excitation prediction unit 605), to obtain a low band excitation signal, and select, from the low band excitation signal, a frequency band with preset bandwidth as the high band excitation signal according to the start frequency bin determined by the start frequency bin determining unit 604.

As an optional implementation manner, the apparatus for predicting a high band excitation signal shown in FIG. 9 may further include:

a third conversion unit 617, configured to convert the calculated spectral frequency parameters obtained by the first acquiring unit 601 to low band LPC coefficients;

a second LPC coefficient prediction unit 618, configured to predict high band or wideband LPC coefficients according to the low band LPC coefficients obtained by means of conversion by the third conversion unit 617;

a third high band signal synthesizing unit 619, configured to synthesize a high band signal by using the high band excitation signal selected by the high band excitation prediction unit 605 and the high band or wideband LPC coefficients predicted by the second LPC coefficient prediction unit 618; and a third wideband signal synthesizing unit 620, configured to combine the low band signal obtained by the first acquiring unit 601 with the high band signal synthesized by the third high band signal synthesizing unit 619, to obtain a wideband signal.

Figure 10:
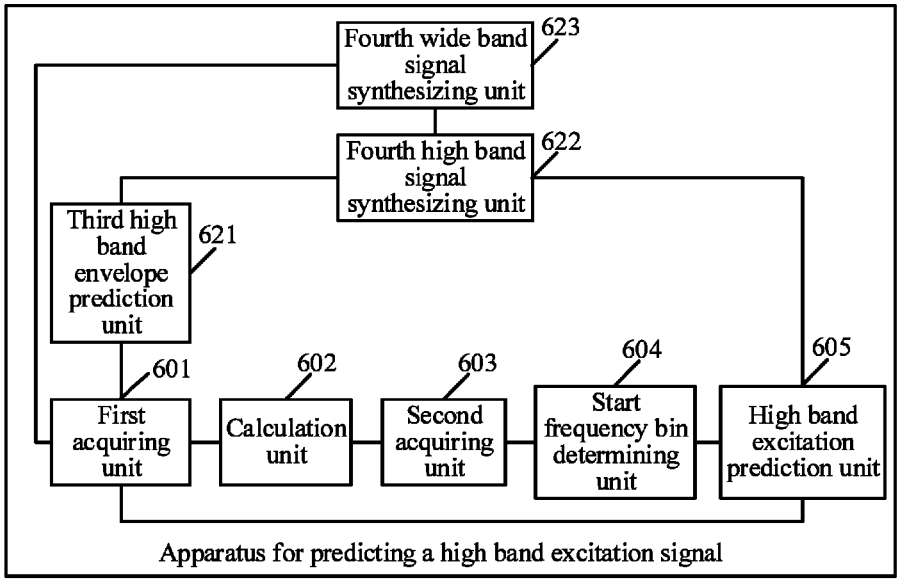
FIG. 10 is a schematic structural diagram of another apparatus for predicting a high band excitation signal disclosed by an embodiment of the present invention.

Also referring to FIG. 10, FIG. 10 is a schematic structural diagram of another apparatus for predicting a high band excitation signal disclosed by an embodiment of the present invention. The apparatus for predicting a high band excitation signal shown in FIG. 10 is obtained by optimizing the apparatus for predicting a high band excitation signal shown in FIG. 6. In the apparatus for predicting a high band excitation signal shown in FIG. 10, the first acquiring unit 601 is also configured to decode the received low band bitstream, to obtain a low band signal, and calculate, according to the low band signal, the set of spectral frequency parameters that are arranged in an order of frequencies; and the high band excitation prediction unit 605 may also be configured to process the low-frequency signal by using an LPC analysis filter (which may be included in the high band excitation prediction unit 605), to obtain a low band excitation signal, and select, from the low band excitation signal, a frequency band with preset bandwidth as a high band excitation signal according to the start frequency bin determined by the start frequency bin determining unit 604.

As an optional implementation manner, the apparatus for predicting a high band excitation signal shown in FIG. 10 may further include:

a third high band envelope prediction unit 621, configured to predict a high band envelope according to the low band signal obtained by the first acquiring unit 601;

a fourth high band signal synthesizing unit 622, configured to synthesize a high band signal by using the high band excitation signal selected by the high band excitation prediction unit 605 and the high band envelope predicted by the third high band envelope prediction unit 621; and a fourth wideband signal synthesizing unit 623, configured to combine the low band signal obtained by the first acquiring unit 601 with the high band signal synthesized by the fourth high band signal synthesizing unit 621, to obtain a wideband signal.

The apparatuses for predicting a high band excitation signal described in FIG. 7 to FIG. 10 can predict a high band excitation signal from a low band excitation signal or a low band signal according to a start frequency bin of the high band excitation signal, which can implement prediction of a high band excitation signal that has good coding quality, so that the high band excitation signal can be better predicted, thereby effectively improving performance of the high band excitation signal. Further, after the apparatuses for predicting a high band excitation signal described in FIG. 7 to FIG. 10 combines a low band signal with a high band signal, performance of a wideband signal can also be improved.

Figure 11:
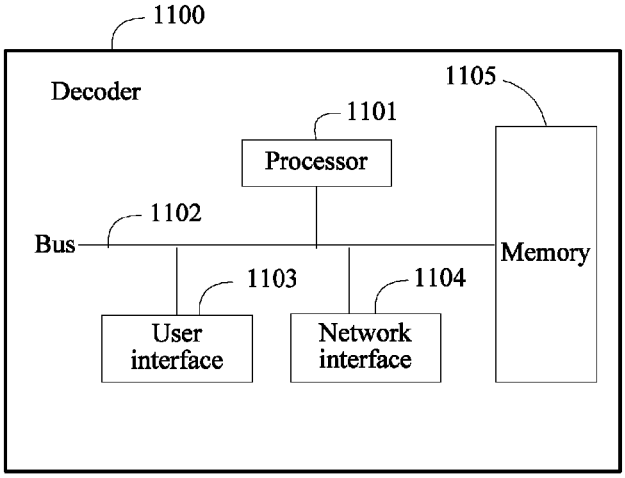
FIG. 11 is a schematic structural diagram of a decoder disclosed by an embodiment of the present invention.

Referring to FIG. 11, FIG. 11 is a schematic structural diagram of a decoder disclosed by an embodiment of the present invention, which is configured to perform the method for predicting a high band excitation signal disclosed by the embodiment of the present invention. As shown in FIG. 10, the decoder 1100 includes: at least one processor 1101, such as a CPU, at least one network interface 1104, a user interface 1103, a memory 1105, and at least one communications bus 1102. The communications bus 1102 is configured to implement a connection and communication between these components. Optionally, the user interface 1103 may include a USB interface, or another standard interface or wired interface. Optionally, the network interface 1104 may include a Wi-Fi interface, or another wireless interface. The memory 1105 may include a high-speed RAM memory, or may further include a non-volatile memory, such as at least one magnetic disk storage. Optionally, the memory 1105 may include at least one storage apparatus located far away from the foregoing processor 1101.

In the decoder shown in FIG. 11, the network interface 1104 may receive a low band bitstream sent by an encoder; the user interface 1103 may be connected to a peripheral device, and configured to output a signal; the memory 1105 may be configured to store a program, and the processor 1101 may be configured to invoke the program stored in the memory 1105, and perform the following operations:

acquiring, according to the low band bitstream received by the network interface 1104, a set of spectral frequency parameters that are arranged in an order of frequencies, where the spectral frequency parameters include low band LSF parameters or low band ISF parameters;

for the acquired set of spectral frequency parameters, calculating a spectral frequency parameter difference between every two spectral frequency parameters that have a same position interval in some or all of the spectral frequency parameters;

acquiring a minimum spectral frequency parameter difference from the calculated spectral frequency parameter differences;

determining, according to a frequency bin that corresponds to the minimum spectral frequency parameter difference, a start frequency bin for predicting a high band excitation signal from a low band; and predicting the high band excitation signal from the low band according to the start frequency bin.

As an optional implementation manner, the acquiring, by the processor 1101 according to the received low band bitstream, a set of spectral frequency parameters that are arranged in an order of frequencies may include:

decoding the received low band bitstream, to obtain the set of spectral frequency parameters that are arranged in an order of frequencies; or decoding the received low band bitstream, to obtain a low band signal, and calculating, according to the low band signal, the set of spectral frequency parameters that are arranged in an order of frequencies.

As an optional implementation manner, if the processor 1101 decodes the received low-frequency bitstream, to obtain the set of spectral frequency parameters that are arranged in an order of frequencies, the processor 11101 may further perform the following operations:

decoding the received low band bitstream, to obtain a low band excitation signal.

Correspondingly, the predicting, by the processor 1101, the high band excitation signal from the low band according to the start frequency bin may include:

selecting, from the low band excitation signal, a frequency band with preset bandwidth as the high band excitation signal according to the start frequency bin.

As an optional implementation manner, the processor 1101 may further perform the following operations:

converting the spectral frequency parameters obtained by decoding to low band LPC coefficients;

synthesizing a low band signal by using the low band LPC coefficients and the low band excitation signal;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

As another optional implementation manner, the processor 1101 may further perform the following operations:

converting the spectral frequency parameters obtained by decoding to low band LPC coefficients;

synthesizing a low band signal by using the low band LPC coefficients and the low band excitation signal;

predicting a high band envelope according to the low band signal; synthesizing a high band signal by using the high band excitation signal and the high band envelope; and combining the low band signal with the high band signal, to obtain a wideband signal.

As an optional implementation manner, if the processor 11101 decodes the received low band bitstream, to obtain the low band signal, and calculates, according to the low band signal, the set of spectral frequency parameters that are arranged in an order of frequencies, the predicting, by the processor 1101, the high band excitation signal from the low band according to the start frequency bin includes:

processing the low-frequency signal by using an LPC analysis filter, to obtain a low band excitation signal; and selecting, from the low band excitation signal, a frequency band with preset bandwidth as the high band excitation signal according to the start frequency bin.

As an optional implementation manner, the processor 1101 may further perform the following operations:

converting the calculated spectral frequency parameters to low band LPC coefficients;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

As another optional implementation manner, the processor 1101 may further perform the following operations:

predicting a high band envelope according to the low band signal;

synthesizing a high band signal by using the high band excitation signal and the high band envelope; and combining the low band signal with the high band signal, to obtain a wideband signal.

The decoder described in FIG. 11 can predict a high band excitation signal from a low band excitation signal or a low band signal according to a start frequency bin of the high band excitation signal, which can implement prediction of a high band excitation signal that have good coding quality, so that the high band excitation signal can be better predicted, thereby effectively improving performance of the high band excitation signal. Further, after the decoder described in FIG. 11 combines a low band signal with a high band signal, performance of a wideband signal can also be improved.

A person of ordinary skill in the art may understand that all or a part of the steps of the methods in the embodiments may be implemented by a program instructing relevant hardware. The program may be stored in a computer readable storage medium. The storage medium may include a flash memory, a read-only memory (Read-Only Memory, ROM), a random access memory (Random Access Memory, RAM), a magnetic disk, and an optical disk.

The method and apparatus for predicting a high band excitation signal disclosed by the embodiments of the present invention are described in detail above. In this specification, specific examples are applied to elaborate the principle and implementation manners of the present invention, and descriptions of the foregoing embodiments are only used to help understand the method and the core idea of the present invention. In addition, a person of ordinary skill in the art may, based on the idea of the present invention, make modifications with respect to the specific implementation manners and the application scope. To sum up, the content of this specification shall not be construed as a limitation to the present invention.

The invention claimed is:

1. A method for predicting a high band excitation signal, comprising:

decoding a received low band bitstream, wherein a set of spectral frequency parameters are acquired via the decoding, wherein the set of spectral frequency parameters have an ordering relationship according to associated frequencies, wherein the spectral frequency parameters comprise low band line spectral frequency (LSF) parameters or low band immittance spectral frequency (ISF) parameters, and wherein a low band excitation signal is synthesized via the decoding;

calculating spectral frequency parameter differences associated with at least two pairs of the spectral frequency parameters, wherein each pair of the spectral frequency parameters are related with a same ordering position interval according to the ordering relationship;

determining, according to a frequency bin that corresponds to a minimum spectral frequency parameter difference, a start frequency bin for predicting a high band excitation signal from the low band excitation signal; and selecting, from the low band excitation signal, a frequency band with a preset bandwidth according to the start frequency bin, to generate the high band excitation signal.

2. The method according to claim 1, wherein the decoding comprises:

generating a low band signal, wherein the set of spectral frequency parameters are acquired based on the low band signal.

3. The method according to claim 1, wherein the method further comprises:

converting the spectral frequency parameters to low band linear prediction coefficient (LPC) coefficients;

synthesizing a low band signal by using the low band LPC coefficients and the low band excitation signal;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

4. The method according to claim 1, wherein the method further comprises:

converting the spectral frequency parameters to low band linear prediction coefficient (LPC) coefficients;

synthesizing a low band signal by using the low band LPC coefficients and the low band excitation signal;

predicting a high band envelope according to the low band signal;

synthesizing a high band signal by using the high band excitation signal and the high band envelope; and combining the low band signal with the high band signal, to obtain a wideband signal.

5. The method according to claim 2, further comprising:

processing the low band signal by using an LPC analysis filter, to obtain the low band excitation signal.

6. The method according to claim 5, wherein the method further comprises:

converting the spectral frequency parameters to low band linear prediction coefficient (LPC) coefficients;

predicting high band or wideband LPC coefficients according to the low band LPC coefficients;

synthesizing a high band signal by using the high band excitation signal and the high band or wide band LPC coefficients; and combining the low band signal with the high band signal, to obtain a wideband signal.

7. The method according to claim 5, wherein the method further comprises:

predicting a high band envelope according to the low band signal;

synthesizing a high band signal by using the high band excitation signal and the high band envelope; and combining the low band signal with the high band signal, to obtain a wideband signal.

8. The method according to claim 1, wherein each pair of the at least two pairs of the spectral frequency parameters comprises two adjacent spectral frequency parameters according to the ordering relationship.

9. The method according to claim 8, further comprising:

correcting the spectral frequency parameter differences using a correction factor, wherein the correction factor varies according to a frequency parameter and wherein the correction factor decreases as the frequency parameter increases, wherein the comparison is based on the corrected spectral frequency parameter differences.

10. The method according to claim 9, wherein each spectral frequency parameter in the at least two pairs of the spectral frequency parameters belongs to a range of the spectral frequency parameters, wherein the range of the spectral frequency parameters corresponds to a subset of the spectral frequency parameters according to the ordering relationship and wherein the range is determined according to a bit rate of the low band bitstream.

11. A decoder, comprising: a processor, a network interface, and a memory; the network interface is configured to receive a low band bitstream sent by an encoder; the memory is configured to store a program, and the processor is configured to execute the program stored in the memory, so as to perform the following operations:

decoding the received low band bitstream, wherein a set of spectral frequency parameters are acquired via the decoding, wherein the set of spectral frequency parameters have an ordering relationship according to associated frequencies, wherein the spectral frequency parameters comprise low band line spectral frequency (LSF) parameters or low band immittance spectral frequency (ISF) parameters, and wherein a low band excitation signal is synthesized via the decoding;

calculating spectral frequency parameter differences associated with at least two pairs of the spectral frequency parameters, wherein each pair of the spectral frequency parameters are related with a same ordering position interval according to the ordering relationship;

determining, according to a frequency bin that corresponds to a minimum spectral frequency parameter difference, a start frequency bin for predicting a high band excitation signal from the low band excitation signal; and selecting, from the low band excitation signal, a frequency band with a preset bandwidth according to the start frequency bin, to generate the high band excitation signal.

12. The decoder according to claim 11, wherein the decoding comprise:

generating a low band signal, wherein the set of spectral frequency parameters are acquired based on the low band signal.

13. The decoder according to claim 11, wherein the operations further comprise:

converting the spectral frequency parameters to low band linear prediction coefficient (LPC) coefficients;

synthesizing a low band signal by using the low band LPC coefficients and the low band excitation signal;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

14. The decoder according to claim 11, wherein the operations further comprise:

processing the low band signal by using an LPC analysis filter, to obtain the low band excitation signal.

15. The decoder according to claim 14, wherein the operations further comprise:

converting the spectral frequency parameters to low band linear prediction coefficient (LPC) coefficients;

predicting high band or wideband LPC coefficients according to the low band LPC coefficients;

synthesizing a high band signal by using the high band excitation signal and the high band or wideband LPC coefficients; and combining the low band signal with the high band signal, to obtain a wideband signal.

16. The decoder according to claim 11, wherein each pair of the at least two pairs of the spectral frequency parameters comprises two adjacent spectral frequency parameters according to the ordering relationship.

17. The decoder according to claim 16, wherein the operations further comprise:

correcting the calculated spectral frequency parameter differences using a correction factor, wherein the correction factor varies according to a frequency parameter and wherein the correction factor decreases as the frequency parameter increases, and wherein the comparison is based on the corrected spectral frequency parameter differences.

18. The decoder according to claim 17, wherein each spectral frequency parameter in the at least two pairs of the spectral frequency parameters belongs to a range of the spectral frequency parameters, wherein the range of the spectral frequency parameters corresponds to a subset of the spectral frequency parameters according to the ordering relationship and wherein the range is determined according to a bit rate of the low band bitstream.

* * * * *